US005536226A

United States Patent [19]

Gordon

[11] Patent Number: 5,536,226

[45] Date of Patent: Jul. 16, 1996

[54] EXERCISE AND THERAPY APPARATUS

[75] Inventor: James R. Gordon, Benton, Ill.

[73] Assignee: Gordon Research & Development, Inc., Pinckneyville, Ill.

[21] Appl. No.: 364,281

[22] Filed: Dec. 27, 1994

[51] Int. Cl.[6] ..... A63B 23/08; A63B 21/045

[52] U.S. Cl. ..... 482/80; 482/127; 482/146; 482/79

[58] Field of Search ..... 482/79, 80, 127, 482/146, 147

[56] References Cited

U.S. PATENT DOCUMENTS

| | | | |
|---|---|---|---|
| 1,587,749 | 6/1926 | Bierly | 482/80 |
| 3,297,320 | 1/1967 | Benedetto | 482/79 |
| 3,929,329 | 12/1975 | Rivera | 482/79 |
| 4,561,649 | 12/1985 | Forsythe | 482/80 |
| 4,693,470 | 9/1987 | Ogawa | 482/79 |
| 4,739,986 | 4/1988 | Kucharik et al. | 482/79 |
| 5,002,272 | 3/1991 | Hofmeister | 482/127 |

*Primary Examiner*—Lynne A. Reichard
*Attorney, Agent, or Firm*—Dorn, McEachran, Jambor & Keating

[57] ABSTRACT

An exercise and physical therapy device for a human anatomical part (e.g. a foot and ankle) has a base plate; a support plate is pivotally mounted on the base plate. An elevating latch mechanism latches the support member at one of several angular positions relative to the base plate. An adjustable, resilient torsion device, capable of both twisting and bending motion, has one end affixed to the support member; a connection member, for connection to the human anatomical part, is mounted on the other end of the torsion device.

16 Claims, 6 Drawing Sheets

EXERCISE AND THERAPY APPARATUS

This invention is directed to a versatile apparatus for exercise and physical therapy that utilizes the adjustable elastomer torsion device described and claimed in the co-pending application of James R. Gordon, Ser. No. 08/262,511 filed Jun. 20, 1994, now U.S. Pat. No. 5,417,407, issued May 23, 1995.

A wide variety of different mechanisms have been devised for use in physical therapy for various parts of the human anatomy. Typically, an impaired ankle or ankle and foot requires exercise, physical therapy, or both to enable a person to overcome the impairment. The same situation may apply to a hand or a hand and wrist, to a forearm, or some other parts of the human anatomy. Many of these mechanisms can be used for both exercise and therapy purposes. It is difficult, if not impossible, to distinguish between their exercise and therapy attributes.

A principal problem with exercise and physical therapy apparatus has been that the apparatus usually is not sufficiently versatile to meet the numerous different physical problems to which human beings are prone. Sometimes this problem is overcome, at least in part, by appropriate provision for changing the parts of the physical therapy apparatus to suit the needs of the person requiring exercise or physical therapy. Changeover of this kind may be difficult and time consuming. Furthermore, due to the wide disparity of individual humans as regards their physical attributes such as strength, weight, size, degree of impairment, etc., an apparatus that is quite appropriate and suitable for use by one individual may be totally unacceptable to another person having the same basic impairment, regardless of modification of the device. That is, a therapeutic exercise device may be lacking in the versatility necessary for conversion to use by different individuals even though those individuals have the same basic problem.

SUMMARY OF THE INVENTION

It is a principal object of the present invention, therefore, to provide a new and improved exercise and physical therapy apparatus that can be readily adapted to a broad variety of individuals having quite different physical characteristics without requiring substantial modification of the apparatus.

Another object of the invention is to provide a new and improved exercise and physical therapy apparatus that provides for bending, twisting, and other exercises at a broad range of resistance levels without requiring major modification of the apparatus, while maintaining construction and use costs at a minimum.

Accordingly, the invention relates to an exercise and physical therapy apparatus for use in the performance of bending exercises, twisting exercises, and combined bending and twisting exercises on a human anatomical part. The apparatus comprises a base plate, a support member, and mounting means for mounting the support member on the base plate for movement over a predetermined range of positions displaced from the base plate. Latch means, connected to the support member and the base plate, are provided for latching the support member at a given position, within the predetermined range, relative to the base plate. There is a resilient, twistable, bendable torsion device having first and second opposite ends, the first end of the torsion device being mounted on the support member so that the torsion device projects from the support member. A connection member is mounted on the second end of the torsion device, the connection member including engagement means engageable with a human anatomical part requiring exercise. The torsion device includes a cylinder member and a core member mounted coaxially in the cylinder member, one of the core and cylinder members having an axial length greater than the other so that the one member projects axially beyond the other. The one member is formed of a resilient elastomer. The torsion device further includes at least one axial spline to maintain the cylinder and core members in coaxial alignment despite axial displacement over a displacement range smaller than the length of the shortest of the core and cylinder members. Torsion locking means lock the core and cylinder members in a predetermined axial relation.

DESCRIPTION OF THE PREFERRED EMBODIMENTS

FIGS. 1 through 4 illustrate an exercise and physical therapy apparatus 10 comprising a preferred embodiment of the present invention. Apparatus 10 is adaptable to bending exercises, to twisting exercises, and to combined bending and twisting exercises performable with and on a human anatomical part at a variety of different starting positions or attitudes. In this specification and in the appended claims, the term "attitude" is used in the same sense as in the case of a ship, aircraft, or the like; thus, "attitude", as used herein, relates to orientation of the anatomical part requiring exercise by rotation about an axis extending longitudinally of the anatomical part and/or about by rotation relative to another axis transverse to the anatomical part. Apparatus 10 is intended to provide for exercise and physical therapy of a human foot and ankle (the "anatomical part"), but the principles and the construction of the apparatus are also applicable to other anatomical parts such as a hand and wrist, a forearm and elbow, or some other part of the human anatomy.

Apparatus 10, as shown in FIGS. 1–4, comprises a base 11 that includes a flat, rigid base plate 12. Base plate 12 may rest on the floor, inasmuch as apparatus 10 is particularly adapted to exercise of a foot and ankle. For other parts of the anatomy, apparatus 10 and its base plate 12 could be mounted on a wall, supported on a floor, or supported on some other surface such as a table or desk.

Figure 1:
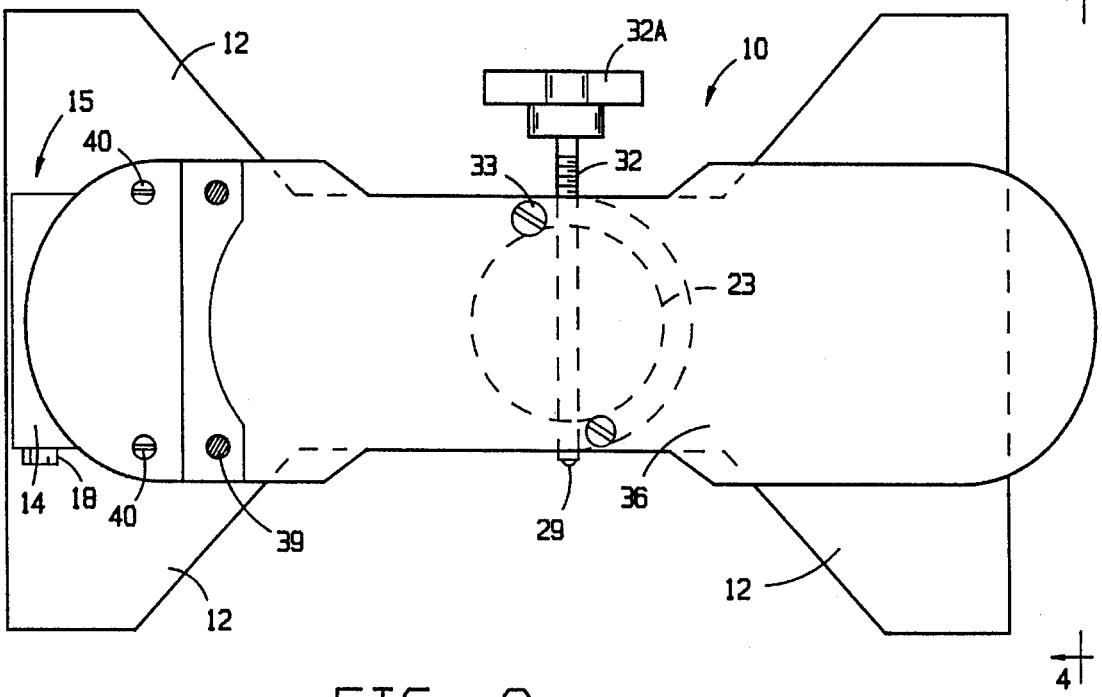
FIG. 1 is a plan view of an exercise and physical therapy apparatus constructed in accordance a preferred embodiment of the invention.
Figure 2:
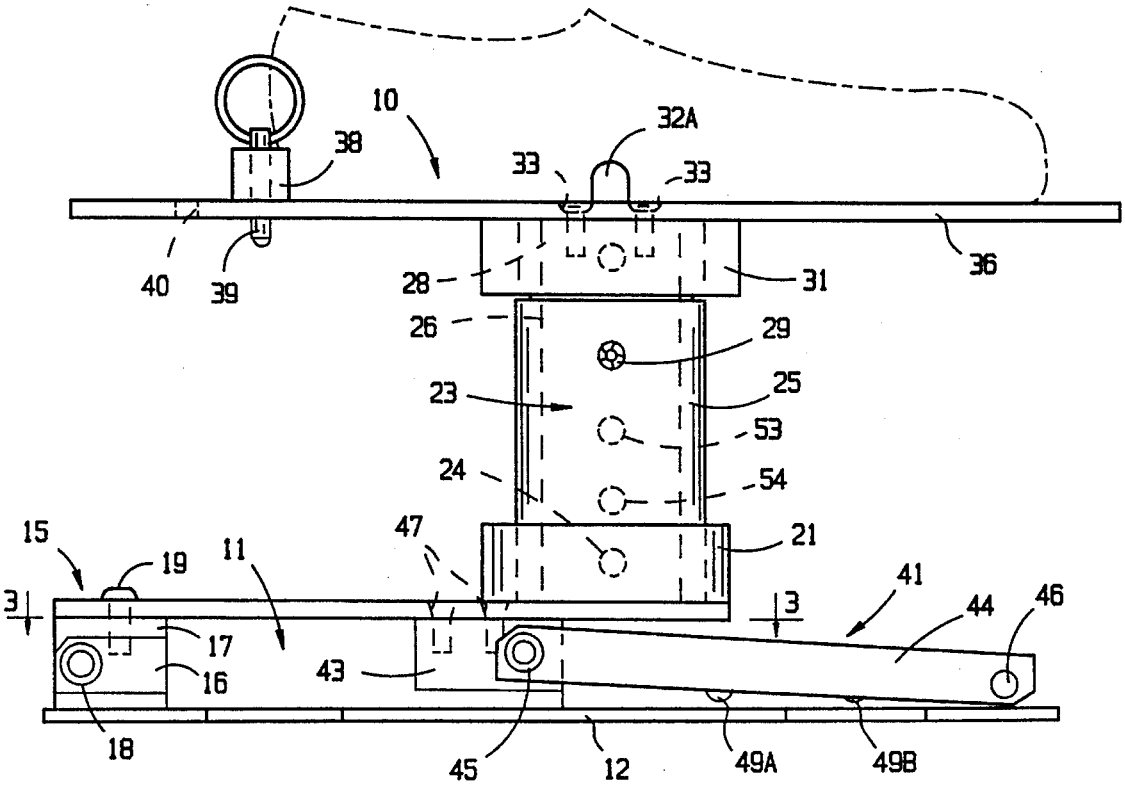
FIG. 2 is a side elevation view of the apparatus of FIG. 1.
Figure 3:
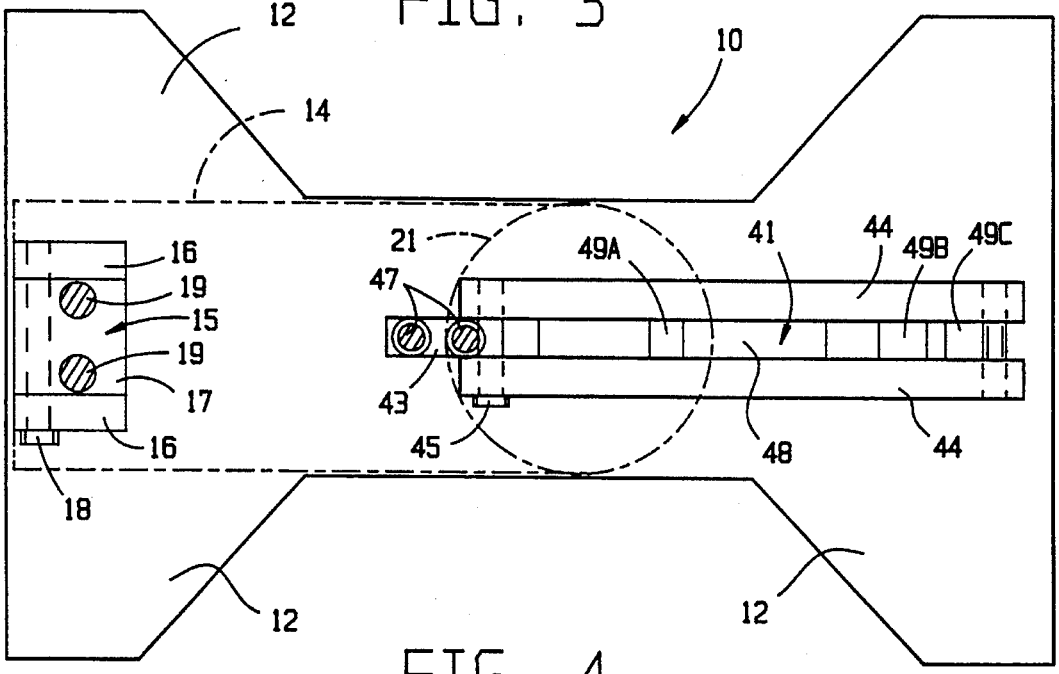
FIG. 3 is a sectional view taken approximately along line 3—3 in FIG. 2.

Base 11 of apparatus 10 further comprises a support member 14 which, in device 10, is an elongated, flat, rigid plate. Device 10 includes pivotal mounting means 15 for pivotally mounting one end of support member 14 on base plate 12. In FIGS. 1–3 pivotal mounting means 15 interconnects the left-hand ends of base plate 12 and support member 14. Mounting means 15 includes a pair of stanchions 16 affixed to and projecting upwardly from base plate 12. The mounting arrangement to affix stanchions 16 to base plate 12 has not been shown; welding, screws, or other appropriate fastening arrangements may be utilized. The two stanchions 16 are located on opposite sides of a pivot block 17 that is secured to support member 14 by appropriate means such as a pair of screws 19. A pivot pin 18 extends horizontally through stanchions 16 and pivot block 17, parallel to the upper surface of base plate 12 and the lower surface of support member 14 but in spaced relation to both.

Figure 4:
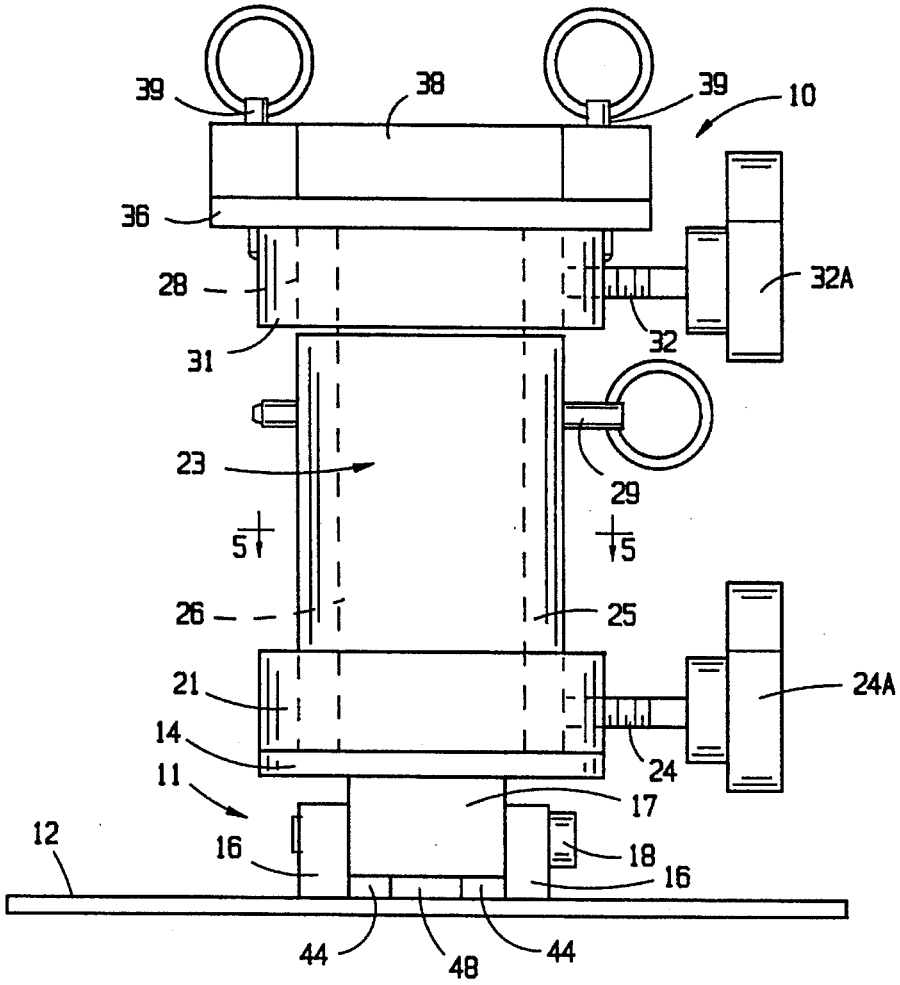
FIG. 4 is an end elevation view of the apparatus taken approximately along line 4—4 in FIG. 1.
Figure 5:
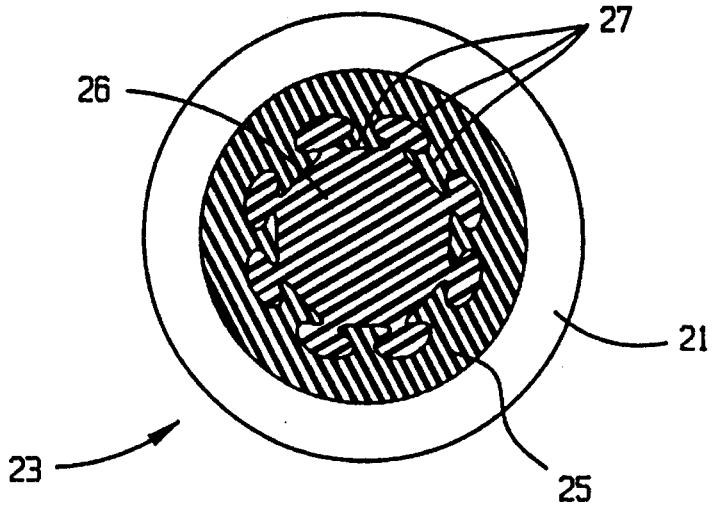
FIG. 5 is a detail sectional view taken approximately along line 5—5 in FIG. 4.

A first cylindrical socket member 21 is affixed to the end of support member 14 opposite pivotal mounting means 15. The manner in which socket 21 is mounted on the cantilever end of support member 14 is not critical; screws, welding, or other appropriate mounting arrangements may be used. An adjustable cylindrical torsion device 23 fits into socket 21 and is held in place there by a set screw 24 operable by a handle 24A as best shown in FIG. 4. Torsion device 23, as shown in the detail view of FIG. 5, includes a cylinder 25 that receives an elongated core 26. Core 26 may be solid, as illustrated, or may be of cylindrical construction. Cylinder 25 and core 26 of torsion device 23 interfit with each other, longitudinally, by means of a plurality of splines 27. The splines appear in FIG. 5; they have been omitted in most other figures in order to avoid undue complication. Torsion device members 25 and 26 can be formed of any elastomeric material, including rubber, synthetic rubber, or elastomeric resins. The preferred material is urethane with a Shore A rating of about 45A to 85A. Several different constructions for the adjustable resilient torsion device 23 are described in the co-pending application of James R. Gordon, Ser. No. 08/262,511 filed Jun. 20, 1994, referred to above.

At the upper end of device 23, core 26 of torsion device 23 projects outwardly of cylinder 25. A separate upper cylinder 28 is mounted upon the upper end of core 26, as shown in FIG. 2 and 4 and as described more fully hereinafter in connection with FIG. 9. Torsion device 23 is adjustable, with respect to its resistance to both bending and twisting, by elevating core 26 relative to cylinder 25. That adjustment is described hereinafter in connection with FIG. 9. FIGS. 2 and 4 show an index pin 29 extending through appropriate apertures in core 26 and cylinder 25. The index pin serves to retain torsion device 23 in a predetermined operating condition as discussed more fully in connection with FIG. 9. In the condition illustrated in FIGS. 1, 2 and 4, the resistance of device 23 to twisting and to bending is at a maximum for the device.

The outer cylinder 28 on the upper end of core 26, FIGS. 2 and 4, fits into a second cylindrical socket 31 that has essentially the same construction as socket 21. A set screw 32 is threaded through socket 31 and is operated by a handle 32A. Set screw 32 connects socket 31 to the upper cylinder or cap portion 28 of torsion device 23.

Apparatus 10, particularly as illustrated in FIGS. 1 and 2, includes a connection member 36 that is mounted upon socket 31 by appropriate means such as a pair of screws 33. Thus, connection member 36 is effectively mounted on the end of device 23 opposite the end of that device that is mounted on support member 14. Because apparatus 10 is particularly intended for use with a human foot and ankle, connection member 36 is constructed in the form of a rigid plate having a configuration roughly like that of a human foot. A heel stop 38 is mounted on one end of connection member 36, preferably at the end of the connection member that extends out over the pivotal mounting means 15 for support plate 14. A pair of index pins 39 are used to secure heel stop 38 to connection member 36. As seen in FIG. 1, there are additional apertures 40 that can receive pins 39 to mount heel stop 38 in a different location on connection member 36, effectively adapting apparatus 10 to use by a person having a larger foot. If desired, more than two positions can be provided for heel stop 38 on connection member 36.

The exercise and therapy apparatus 10 further comprises an elevating latch means 41 that is best illustrated in FIGS. 2 and 3. A part of the latch mechanism appears in FIG. 4.

Elevating latch means 41 includes a mounting block 43 mounted on the bottom of support member 14 (FIG. 2) at a location intermediate mounting means 15 and collar 21. Any appropriate means may be utilized to mount block 43 on support member 14; in FIGS. 2 and 3 the mounting means are shown as two screws 47. Mounting block 43 is connected to one end of each of a pair of levers 44. As best shown in FIG. 3, the two levers 44 project parallel to each other away from block 43 and are connected to block 43 by a pivot pin 45. The other, outer ends of levers 44 are interconnected by a latch pin 46. Pin 46 is used in conjunction with the slots 49A–49C in a latch plate 48 that is mounted on base plate 12 and projects upwardly between levers 44. The use of elevating latch means 41 is explained more fully hereinafter in connection with FIGS. 6A–6C. The mounting means used to secure latch plate 48 to base plate 12 has not been shown in the drawings; screws, welding, or other appropriate mounting arrangements may be employed.

Figure 6A:
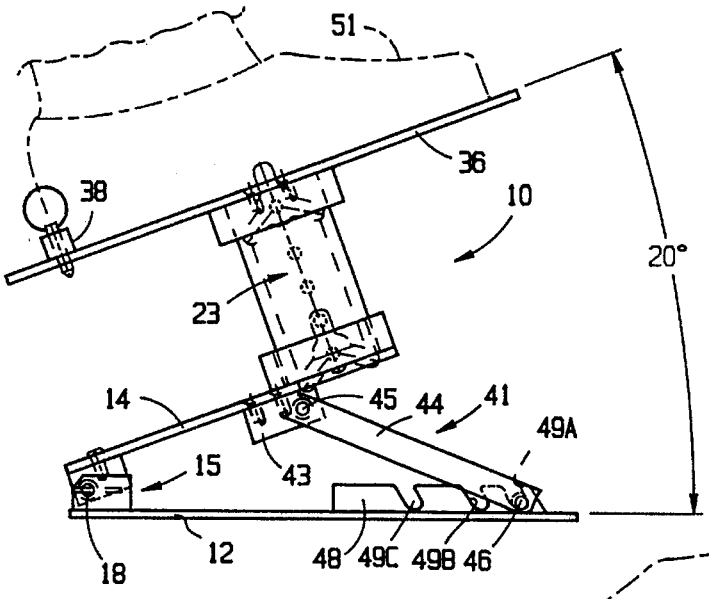
FIGS. 6A–6C are side elevation views, similar to FIG. 2 but on a smaller scale, illustrating different angular operating positions for the apparatus of FIGS. 1–4.
Figure 6B:
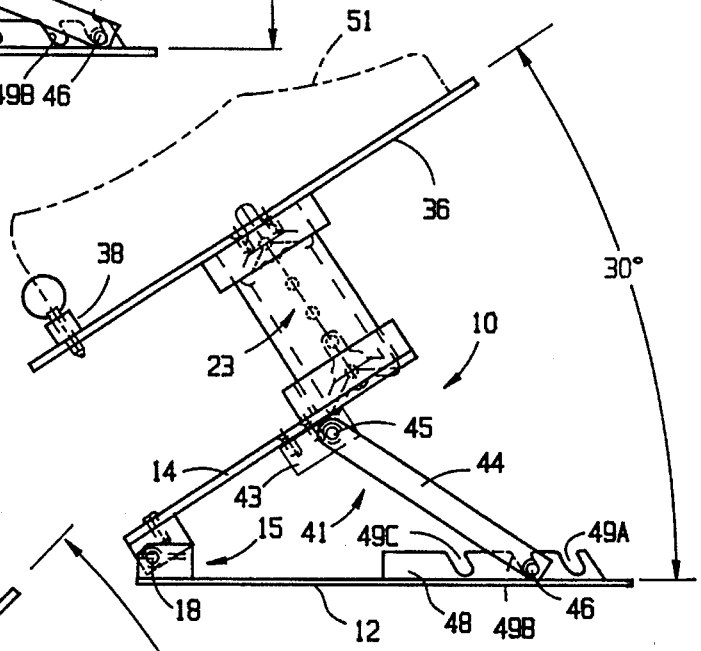
Figure 6C:
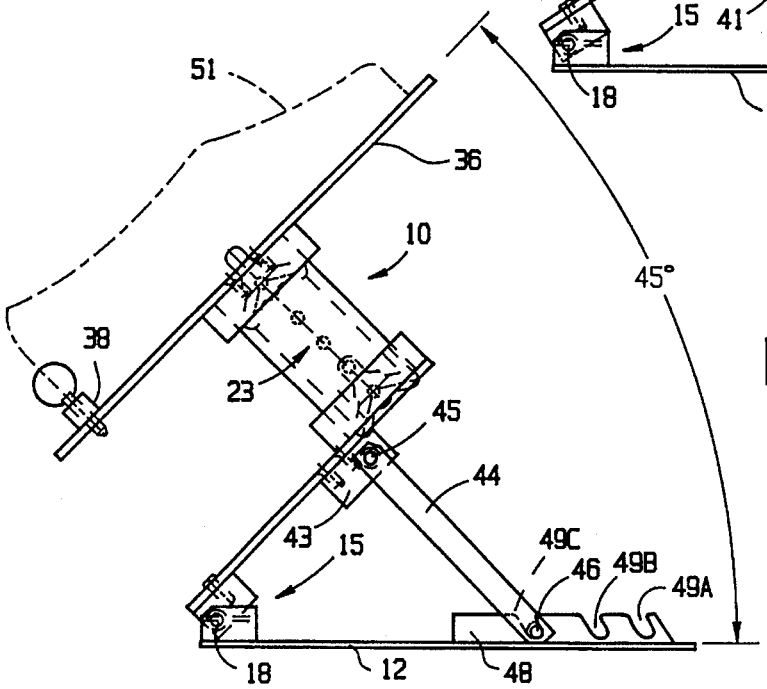

FIGS. 6A–6C illustrate the use of the elevating latch mechanism 41 in setting the therapy and exercise mechanism 10 for use at three different attitudes over and above the initial attitude shown in FIGS. 1–4, in which support member 14 and connection member 36 are both parallel to base plate 12. FIG. 6A shows the elevating latch mechanism 41 with latch pin 46 inserted in the outermost slot 49A in latch plate 48. FIG. 6B shows apparatus 10 with its latching mechanism 41 in an alignment in which pin 46 is inserted in slot 49B of latch plate 48. FIG. 6C illustrates the attitude of the mechanism of apparatus 10 when latch pin 46 is engaged in slot 49C of plate 48.

In the alignment shown in FIG. 6A, levers 44 have been lifted and the pivot pin 46 that joins the outer ends of the two levers has been inserted in slot 49A at the outer end of latch plate 48. With this alignment, support plate 14 and connection member 36 are moved to an alignment or attitude that is approximately 20° from the parallel position shown in FIGS. 1–4. The axis of the pivotal movement is the longitudinal axis of the pivot pin 18 of the mounting means 15 that mounts support member 14 on base plate 12. The overall effect, with respect to apparatus 10, is to tilt the connection plate 36 through an angle of 20° so that the anatomical part undergoing exercise or therapy, shown as a foot 51, starts at an angle of 20° to the horizontal instead of at the horizontal position illustrated in FIG. 2.

In those instances in which a greater angle is desired for an exercise, the latch lever 44 of mechanism 41 is again lifted and pivot pin 46 is inserted in slot 49B, as shown in FIG. 6B. With this alignment, support member 14 and connection member 36 are realigned at an angle of approximately 30° from the horizontal. Of course, this means that the foot 51 starts at an attitude tilted 30° to the horizontal. A third position, shown in FIGS. 6C, has pin 46 engaged in the third slot 49C of plate 48. In this alignment, support member 14 and connection member 36 are realigned at an angle of 45° relative to base plate 12. Accordingly, foot 51 starts the exercise at an attitude of about 45° to the horizontal. Any of the three positions shown in FIGS. 6A through 6C, or the horizontal position illustrated in FIG. 2, may be desirable for use in a given therapy or exercise situation. In part, the selection may be made on the basis of the position to be assumed by the user of apparatus 10. If that person is seated in a wheelchair, any of the three positions shown in FIGS. 6A–6C may prove to be the best for a particular foot and ankle exercise.

Figure 7:
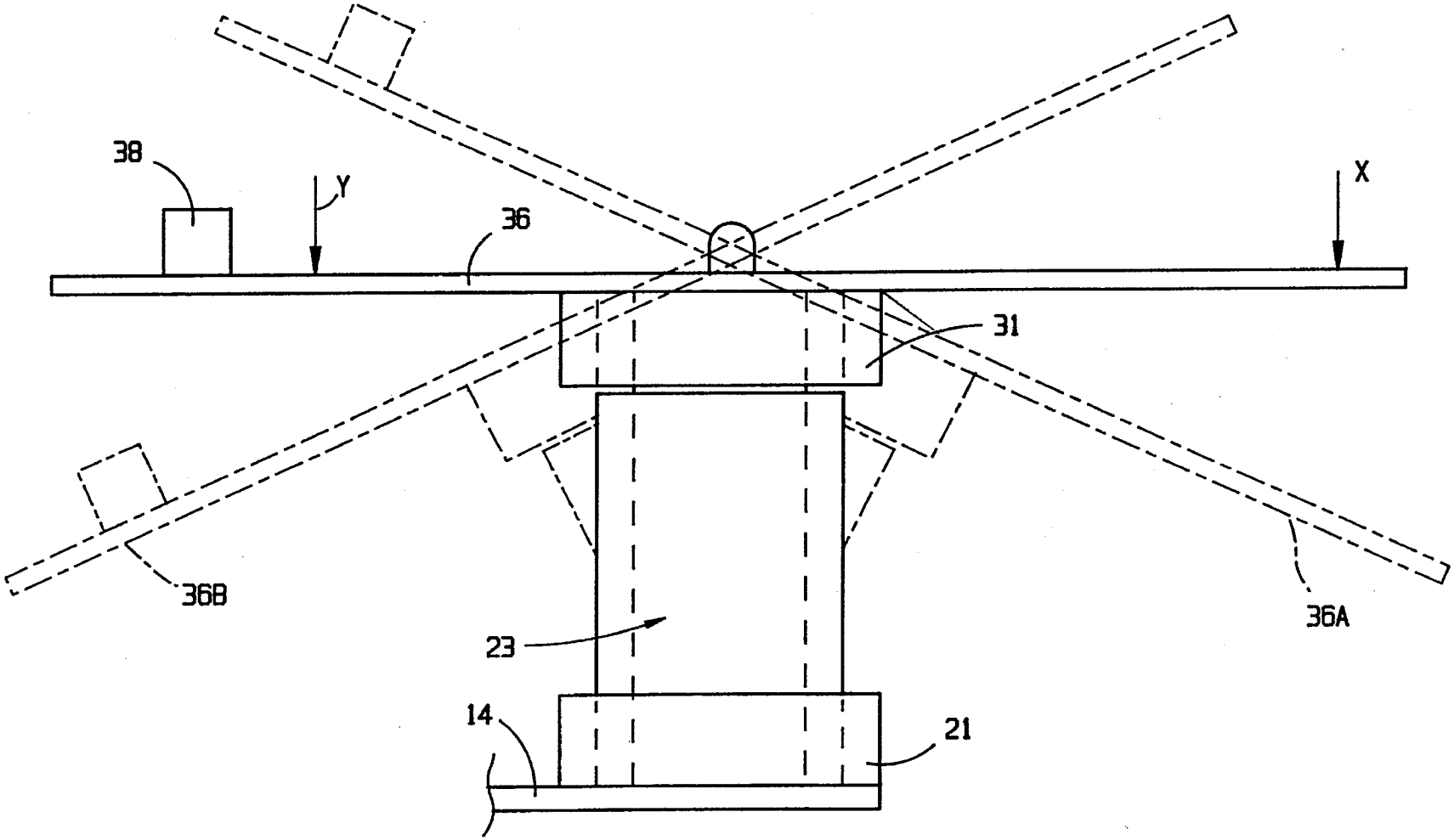
FIG. 7 is a detail view illustrating front-to-back deflection of the apparatus of FIGS. 1–4.

FIG. 7 illustrates the bending or flexure movement of connection member 36 available to the user of the therapy and exercise device 10. When no exercise is being carried out, connection member 36 is oriented in a direction parallel to support member 14 by virtue of its mounting on socket 31 at the upper end of torsion device 23. When the user pushes downwardly on the right-hand end of the connection member 36, as seen in FIG. 7, device 23 flexes by bending to the right and connection member 36 is driven to the deflected position shown by phantom outline 36A. Conversely, when the user pushes downwardly on the left-hand end of connection member 36, as indicted by arrow Y, device 23 flexes in the opposite direction and member 36 is deflected to the position 36B. The phantom outlines for torsion device 23 in FIG. 7 represent approximately the limits of movement for application of force by a normal user. For a person with an impaired foot or ankle, the angle may be substantially smaller.

Figure 8:
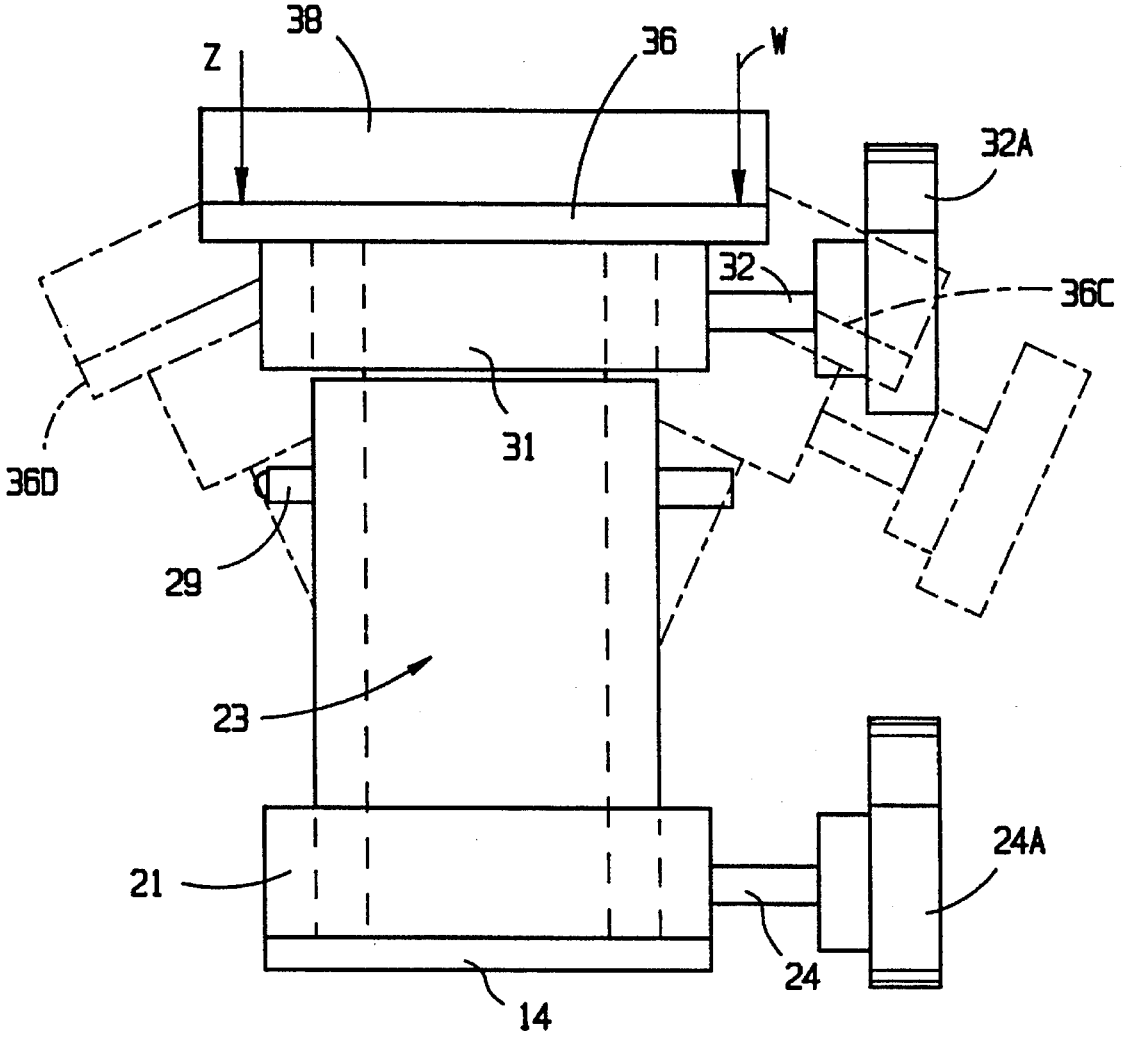
FIG. 8 is a detail view illustrating side-to-side deflection of the apparatus.

As shown in FIG. 8, the same range of movement is available for flexure or bending movement in a direction normal to that shown in FIG. 7. Thus, torsion device 23 permits bending movement of connection member 36 to either of the two phantom positions 36C and 36D when the user of the therapy and exercise device applies pressure to member 36 as indicated by arrows W and Z respectively. Positions 36C and 36D are approximate, of course, because the capability of different users in applying force in the direction of arrows W and Z will vary to a substantial extent. Of course, this applies equally to the range of movement illustrated in FIG. 7.

Figure 9:
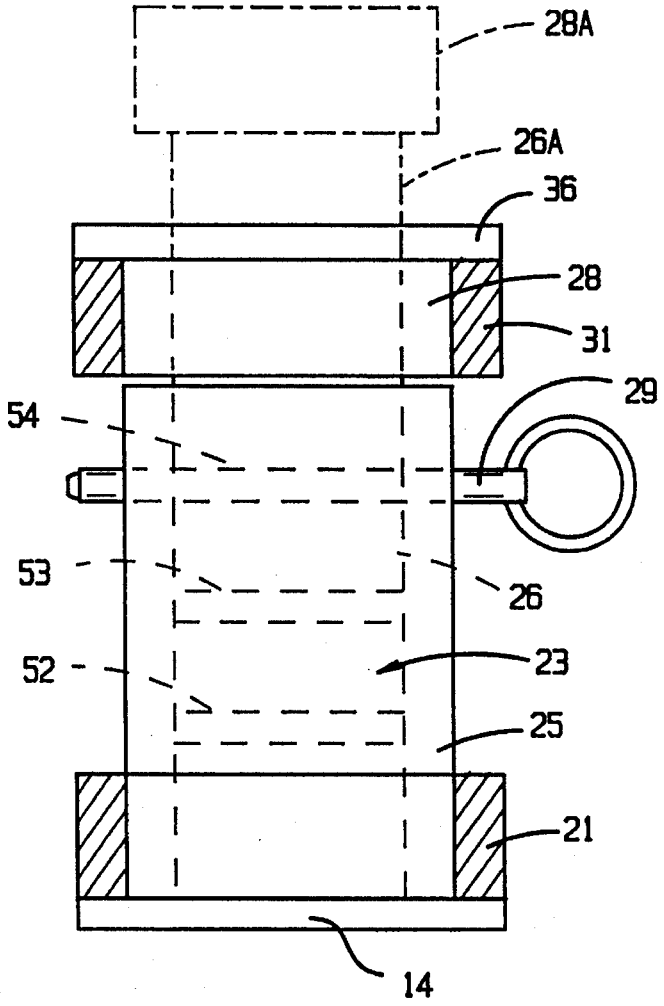
FIG. 9 is a detail view illustrating the limits of adjustment of the torsion device in the apparatus of FIGS. 1–4 for adjustment of bending and twisting resistance.

FIG. 9 illustrates the manner in which torsion device 23 may be adjusted to modify the resistance of that device to both bending and twisting. Torsion device 23 is shown in solid lines in FIG. 9, with the two sockets 21 and 31 that mount device 23 in apparatus 10 cut away to show device 23 more clearly. Support member 14 and connection member 36 are also illustrated in solid lines in FIG. 9, along with index pin 29. The solid line portion of FIG. 9 shows these members in the maximum resistance position that has also been shown in the earlier figures, e.g., FIGS. 1, 2 and 4.

To reduce the resistance of torsion device 23, both to bending or flexural movement and to twisting movement, index pin 29 is removed. With index pin 29 out of the way, core 26 can be pulled upwardly to position 26A. The index pin 29 can then be replaced, through the core and lower cylinder of torsion device 23, holding core 26 in an elevated or extended position relative to cylinder 25. Thus index pin 29 remains in the same location with respect to cylinder 25 as before. But the index pin now extends through a different aperture 54 in core 26; previously, index pin 29 had been inserted through core aperture 52.

Stated differently, with index pin 29 engaged in core aperture 52, the core is maintained in its fully inserted position in cylinder 25 and affords maximum resistance to both twisting and bending. That is the condition illustrated in FIGS. 1–4. With core 26 pulled up to position 26A, however, as in the phantom lines of FIG. 9, and with index pin 29 inserted through core aperture 54, the bottom of the core is located at phantom line 26B. Thus, it projects outwardly of cylinder 25 by a greater distance and is easier to bend; twisting of core 26 also gives rise to less resistance. The connection member 36 of apparatus 10 has moved up to phantom position 36A and collar 31 is at position 31A. The end result is little different, as far as the user is concerned, except that torsion device 23 can now bend or twist much more easily than before. An intermediate diametrical adjustment aperture 53 through core 26 can be utilized to afford an intermediate position with respect to the resistance of device 23 to both twisting and bending movements. The number of apertures through core 26 determines the number of resistance settings available for adjustable torsion device 23.

From the foregoing description it will be apparent that the exercise and physical therapy apparatus 10 is readily adaptable to a broad variety of individuals having quite different physical characteristics without requiring substantial modification of the apparatus. Apparatus 10 can be used to meet virtually any exercise or therapy requirement for bending, twisting, or both with respect to an anatomical part (here, a foot and ankle) secured to connection member 36. Additional fasteners, such as straps, may be used as desired or required. If torsion device 23 is too stiff or too compliant to fit the needs of an individual user (or therapist) it is a simple matter to release set screws 24 and 32, replacing device 23 with a like torsion adjustment device that has the desired compliance/resistance characteristic. Construction and use costs, in apparatus 10, are effectively minimized; versatility and adaptability are maximized.

We claim:

1. An exercise and physical therapy apparatus for the performance of bending exercises, twisting exercises, and combined bending and twisting exercises on a human anatomical part, the apparatus comprising:

a base plate;

a support member;

mounting means for mounting the support member on the base plate for movement over a predetermined range of positions displaced from the base plate;

latch means, connected to the support member and the base plate, for latching the support member at a given position, within the predetermined range, relative to the base plate;

a resilient, twistable, bendable torsion device having first and second opposite ends, the first end of the torsion device being mounted on the support member so that the torsion device projects from the support member; and a connection member, mounted on the second end of the torsion device, the connection member including engagement means engageable with a human anatomical part requiring exercise;

in which the torsion device comprises:

a cylinder member;

a core member mounted coaxially in the cylinder member;

one of the core and cylinder members having an axial length greater than the length of the other of the core and cylinder members so that one of the core and cylinder members projects axially beyond the other, the one member being formed of a resilient elastomer;

alignment means, including at least one axially longitudinal spline interconnecting the exterior of the core member and the interior of the cylinder member to maintain the core and cylinder members in coaxial alignment despite displacement of the core member axially of the cylinder member over a displacement range smaller than the length of the shortest of the core and cylinder members; and torsion locking means for locking the core member at a predetermined axial position relative to the cylinder member.

2. An exercise and physical therapy apparatus according to claim 1 in which:

the support member is an elongated, rigid member having a pivot end and a cantilever end;

the mounting means for the support member is a pivotal mount pivotally mounting one end of the support member on the base plate for pivotal movement relative to the base plate; and the latch means latches the support member at a predetermined angle to the base plate.

3. An exercise and physical therapy apparatus according to claim 2 in which the latch means comprises:

a latch lever having a mounting end and a latch end;

latch mounting means pivotally mounting the mounting end of the latch lever on the support member;

a latch plate, mounted on the base plate, having at least one latch slot; and a latch pin affixed to and projecting from the latch end of the latch lever, engageable in the latch slot of the latch plate.

4. An exercise and physical therapy apparatus according to claim 3 in which the latch plate includes a plurality of latch slots spaced from each other, and the latch pin is engageable in any one of the latch slots to latch the support member at one of a corresponding plurality of different angular displacements relative to the base plate.

5. An exercise and physical therapy device according to claim 1 in which both the core member and the cylinder members are formed of a resilient elastomer.

6. An exercise and physical therapy device according to claim 5 in which the elastomer is urethane.

7. An exercise and physical therapy apparatus according to claim 1 in which the torsion locking means comprises:

a first radial aperture through one of the core and cylinder members;

a second radial aperture through the other of the core and cylinder members;

and an index pin extending through both the first and the second radial apertures to lock the core and cylinder members in a predetermined axial alignment with each other.

8. An exercise and physical therapy apparatus according to claim 7 in which the torsion locking means further comprises a plurality of first radial apertures axially displaced from each other, and the index pin extends through one of the first radial apertures and into the second radial aperture to lock the core and cylinder members in any one of a plurality of different axial alignments relative to each other.

9. An exercise and physical therapy apparatus according to claim 1 and further comprising:

releasable mounting means for mounting the engagement means at a plurality of different positions on the connection member.

10. An exercise and physical therapy apparatus according to claim 1 in which the torsion device is releasably mounted on the support member and the connection member is releasably mounted on the torsion device so that the torsion device can be quickly replaced in the apparatus.

11. An exercise and physical therapy apparatus for the performance of bending exercises on a human anatomical part, the apparatus comprising:

a base including a support member;

a resilient, bendable elastomer torsion device having first and second opposite ends with the first end of the torsion device mounted on the support member;

means for adjusting the torsion device to vary the resistance of the torsion device to bending; and a connection member, mounted on the second end of the torsion device, the connection member being connectable to a human anatomical part.

12. An exercise and physical therapy apparatus according to claim 11 in which the base further comprises:

a base plate; and pivotal mounting means for mounting the support member on the base plate for pivotal movement relative to the base plate over a predetermined arcuate attitude range.

13. An exercise and physical therapy apparatus according to claim 12 and further comprising:

latch means, interconnecting the support member and the base plate, for latching the support member at one of a plurality of different attitude positions within said range.

14. An exercise and physical therapy apparatus for the performance of twisting exercises on a human anatomical part, the apparatus comprising:

a base including a support member;

a resilient, twistable elastomer torsion device having first and second opposite ends with the first end of the torsion device mounted on the support member;

means for adjusting the torsion device to vary the resistance of the torsion device to twisting; and a connection member, mounted on the second end of the torsion device, the connection member being connectable to a human anatomical part.

15. An exercise and physical therapy apparatus according to claim 14 in which the base further comprises:

a base plate; and pivotal mounting means for mounting the support member on the base plate for pivotal movement relative to the base plate over a predetermined arcuate attitude range.

16. An exercise and physical therapy apparatus according to claim 15 and further comprising:

latch means, interconnecting the support member and the base plate, for latching the support member at one of a plurality of different attitude positions within said range.

* * * * *